US009711843B2

(12) United States Patent
Rogers

(10) Patent No.: US 9,711,843 B2
(45) Date of Patent: Jul. 18, 2017

(54) SYSTEMS AND METHODS FOR AN ANTENNA CONFORMAL TO A SPHERE

(71) Applicant: Honeywell International Inc., Morris Plains, NJ (US)

(72) Inventor: Shawn David Rogers, Johns Creek, GA (US)

(73) Assignee: Honeywell International Inc., Morris Plains, NJ (US)

( * ) Notice: Subject to any disclaimer, the term of this patent is extended or adjusted under 35 U.S.C. 154(b) by 99 days.

(21) Appl. No.: 14/918,425

(22) Filed: Oct. 20, 2015

(65) Prior Publication Data

US 2017/0110785 A1 Apr. 20, 2017

(51) Int. Cl.
*H01Q 1/24* (2006.01)
*H01Q 1/40* (2006.01)

(52) U.S. Cl.
CPC ..... *H01Q 1/243* (2013.01); *H01Q 1/405* (2013.01)

(58) Field of Classification Search
CPC ..... H01Q 1/40; H01Q 1/405
See application file for complete search history.

(56) References Cited

U.S. PATENT DOCUMENTS

| | | | | |
|---|---|---|---|---|
| 4,201,987 | A | 5/1980 | Tricoles et al. | |
| 4,270,106 | A | 5/1981 | Woermbke | |
| 2007/0188397 | A1 | 8/2007 | Parsche | |
| 2012/0244815 | A1 * | 9/2012 | Altan | H04B 7/0857 455/63.1 |

OTHER PUBLICATIONS

Johnson, "Antenna Engineering Handbook", 1993, pp. 1, 6-11-6-13, 8-9-8-14, vol. 3rd, Publisher: Georgia Institute of Technology, Published in: US.
Dixon, Paul. "Dampening cavity resonance using absorber material", Microwave Technology, May 2004, pp. 16-19.

* cited by examiner

*Primary Examiner* — Robert Karacsony
(74) *Attorney, Agent, or Firm* — Fogg & Powers LLC

(57) ABSTRACT

Systems and methods for an antenna conformal to a sphere are provided. In certain implementations, an apparatus comprises a sphere having a recessed portion formed therein, the sphere enclosing instrumentation that produces a transmittable electronic signal; central conductor placed within the recessed portion, wherein the central conductor is coupled to the instrumentation to receive the transmittable electronic signal, wherein the transmittable electronic signal is emitted outside of the sphere; and an insulator cap located over the recessed portion, wherein locations on the external surface of the insulator cap and an external facing surface of the central conductor are substantially equidistant from a center point of the sphere.

20 Claims, 6 Drawing Sheets

SYSTEMS AND METHODS FOR AN ANTENNA CONFORMAL TO A SPHERE

STATEMENT REGARDING FEDERALLY SPONSORED RESEARCH OR DEVELOPMENT

This invention was made with Government support under USAF AFRL/RV. The Government has certain rights in this invention.

BACKGROUND

In certain systems, electromagnetic signals are emitted from a sphere. For example, a cavity may be formed between two spherical caps one surface formed from an outer shell and another formed by an inner sphere. A transmitter from within the inner sphere may transmit a signal into the cavity through an antenna.

SUMMARY

Systems and methods for an antenna conformal to a sphere are provided. In certain implementations, an apparatus comprises a sphere having a recessed portion formed therein, the sphere enclosing instrumentation that produces a transmittable electronic signal; central conductor placed within the recessed portion, wherein the central conductor is coupled to the instrumentation to receive the transmittable electronic signal, wherein the transmittable electronic signal is emitted outside of the sphere; and an insulator cap located over the recessed portion, wherein locations on the external surface of the insulator cap and an external facing surface of the central conductor are substantially equidistant from a center point of the sphere.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
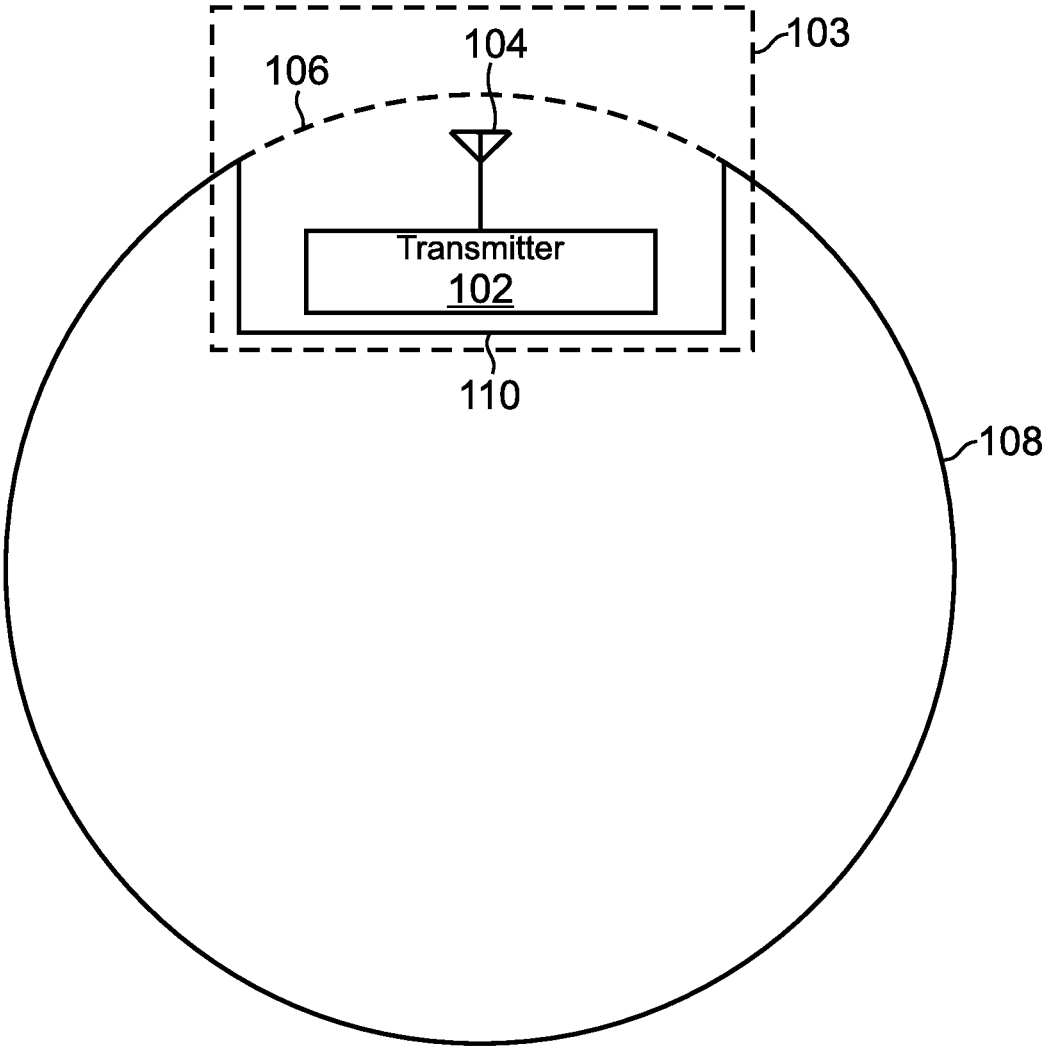
FIG. 1 is a diagram of a sphere containing an antenna that is conformal to the sphere in one embodiment described in the present disclosure.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Embodiments described herein provide systems and methods for an antenna conformal to a sphere. The antenna may be conformal to a sphere by being contained within the radius of the sphere to which it is mounted. The antenna may couple energy from the interior of the sphere to the exterior of the sphere. In one particular embodiment, the antenna may couple energy from the interior of the sphere into a spherical waveguide cavity formed between the exterior surface of the sphere and the interior surface of a concentric metal shell. To propagate within the spherical waveguide cavity, the antenna couples the electric field into the cavity with a polarization that is normal (perpendicular) to the surface of the sphere and the surface of the shell. As the antenna generates the appropriate polarization of electric field for propagating in the spherical waveguide, the antenna provides a good return loss with little power reflected at the terminals of the antenna. For example, certain embodiments described herein may exhibit a return loss value of −12 dB to below −20 dB (with only 6% and 1% reflected power, respectively).

FIG. 1 is a diagram of an antenna 103 that has a surface that is conformal with the outer surface of a sphere 108. The sphere 108 may be substantially fabricated from a material that reflects electromagnetic energy, such as metal. In certain implementations, the sphere 108 is reflective of electromagnetic energy along the surface of the sphere 108 save at a recessed portion 110, where the antenna 103 is located at the recessed portion 110. Also, a transmitter 102 located within the sphere may be coupled to the antenna 103. The transmitter 102 drives the antenna by providing electromagnetic energy that is then emitted by the antenna 103 from the surface of the sphere 108. In one implementation, the transmitter 102 is located within the recessed portion 110 of the sphere 108. Alternatively, the transmitter 102 may be located within the interior of the sphere 108, where the transmitter 102 connects to the antenna 103 through a connection (such as a coaxial connection) that extends from the interior of the sphere 108 into the recessed portion 110. In an alternative implementation, the recessed portion 110 is a functional part of the antenna 103 and the antenna 103 includes a central conductor 104 that functions as an inner conductor for a coaxial connector and the recessed portion 110 functions as an outer conductor for a coaxial connector that is coupled to a receiver or a receiver/transmitter.

In certain implementations, to preserve the shape of the sphere 108 while isolating the central conductor 104 from the recessed portion 110, an insulator cap 106 is placed over the recessed portion 110. In certain implementations, the insulator cap 106 is non-metallic and functions as a radome, allowing electromagnetic energy emitted within the recessed portion 110 to pass through the insulator cap 106. In at least one implementation, an outer surface of the insulator cap 106 functions as a portion of the outer surface of the antenna 103, where the outer surface is the surface farthest from the center of the sphere 108. In certain implementations, the insulator cap 106 is fabricated in the shape of a disk with a hole in the center, where the central conductor 104 is placed. Accordingly, the central conductor 10 directly emits a portion of the electromagnetic energy emitted from the antenna 103 whereas the recessed portion may also reflect a portion of the electromagnetic energy emitted from the central conductor 104 through the insulator cap 106. External surfaces of the insulator cap 106 and the central conductor 104 are substantially equidistant from the center of the sphere 108 and, accordingly, conform to the surface of a sphere while emitting electromagnetic energy. In certain implementations, the antenna 103 is able to emit an electric field having a polarization that is normal (perpendicular) to the surface of the sphere 108 at the location where the electromagnetic energy is emitted.

Figure 2:
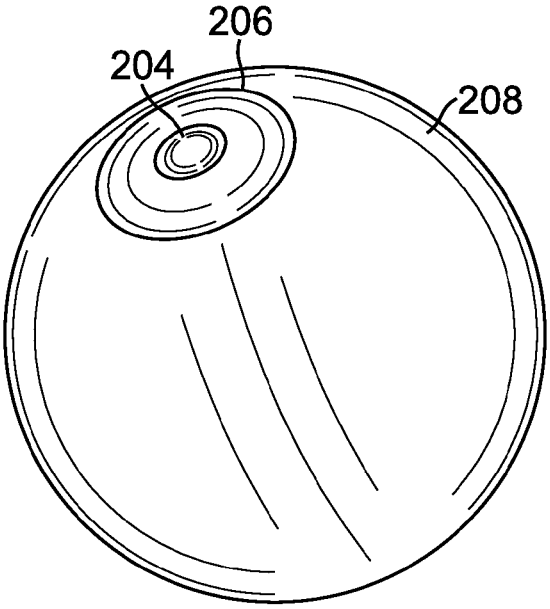
FIG. 2 is an external view of a sphere containing an antenna that is conformal to the sphere in one embodiment described in the present disclosure.

FIG. 2 is a diagram of the external surface of a sphere 208, where the sphere 208 and components contained therein function similarly as described above in relation to the components described in FIG. 1. For example, sphere 208 may be fabricated from a metallic material that reflects electromagnetic energy. Further, the sphere 208 may enclose instrumentation such as a sensor or other instrumentation that is able to gather data for transmission to a device outside of the sphere 208. To transmit the data, the sphere 208 is not a complete sphere but rather contains a recessed portion containing an antenna that includes an insulator cap 206 and a central conductor 204 that is coupled to a transmitter within the sphere 208. The insulator cap 206 and the central conductor 204 of the antenna include surfaces that form a transmitting surface that is conformal with the surface of the sphere 208, such that the antenna is able to emit signals from the surface of the sphere 208.

In further implementations, as both the sphere 208 and the central conductor 204 are fabricated from electrically conductive material, the insulator cap 206 electrically isolates the sphere 208 from the central conductor 204 from one another. To electrically isolate the central conductor 204 from the sphere 208, an insulator cap 206 may be positioned around the central conductor 204 to hold the central conductor 204 in place in relation to the sphere 208 while maintaining the spherical shape over the recessed portion of the sphere 208. The insulator cap 206 may be fabricated from a dielectric material that permits electromagnetic energy to pass through such as material that is commonly used for radomes as understood by one having skill in the art. As mentioned previously, electromagnetic energy emitted by the central conductor 204 within the recessed portion of the sphere 208 may be reflected by the surface of the recessed portion to pass through the insulator cap 206 for propagation outside the sphere 208.

Figure 3:
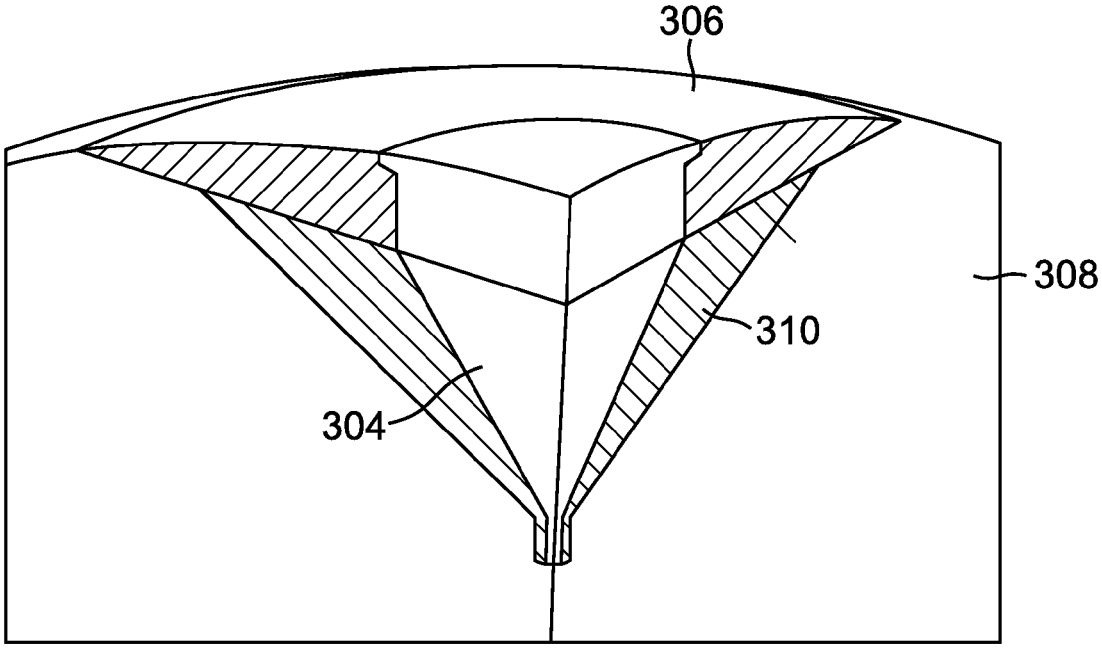
FIG. 3 is a cross sectional view of an antenna that is conformal to a sphere in one embodiment described in the present disclosure.

FIG. 3 is a cross-sectional view of the antenna described above in FIGS. 1 and 2. As illustrated, a sphere 308 includes a recessed portion 310, where a central conductor 304 extends towards the surface of the sphere 308 through the recessed portion 310. Further, the recessed portion 310 may be capped with an insulator cap 306. As shown herein the sphere 308, antenna 304 and insulator cap 306 function substantially as described with regards to sphere 208, antenna 204 and insulator cap 206 described above in relation to FIG. 2. Further, as illustrated, the central conductor 304 may extend through the recessed portion 310 to connect to instrumentation located within the sphere 308. As the central conductor 304 and the surface of the recessed portion 310 may both be electrically conductive, an insulator may prevent the central conductor 304 from contacting the surface of the recessed portion 310 at the point where the central conductor 304 passes through the surface of the recessed portion 310 to connect to instrumentation within the sphere 308.

Figure 4A:
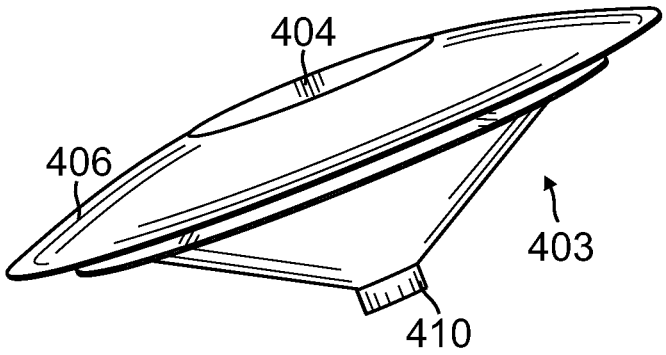
FIG. 4A-4E are diagrams of individual antenna components for an antenna conformal to a sphere in one embodiment described in the present disclosure.

FIGS. 4A-4E illustrate the different components described above in relation to FIGS. 1-3. In particular FIG. 4A illustrates the same components of FIG. 3 other than the sphere 308. For example, FIG. 4A illustrates an external view of an assembled antenna 403 that may be placed within a sphere such as sphere 108 described in FIG. 1. The antenna 403, as illustrated, includes a recessed portion 410 with an insulator cap 406 securing the central conductor 404 within the recessed portion 410. As shown here, the recessed portion 410 appears as a different component that is removable from a sphere. However, in certain implementations, the recessed portion 410 may be fabricated as part of a sphere. For example, the sphere may be comprised of a first hemisphere and a second hemisphere, where the recessed portion 410 is part of one or both of the first or second hemispheres. Further, the sphere may also be fabricated as separate hemispheres with a separately manufactured recessed portion 410 that is connected to a hole in one of the different hemispheres or a hole that is partially formed in both hemispheres.

Figure 4B:
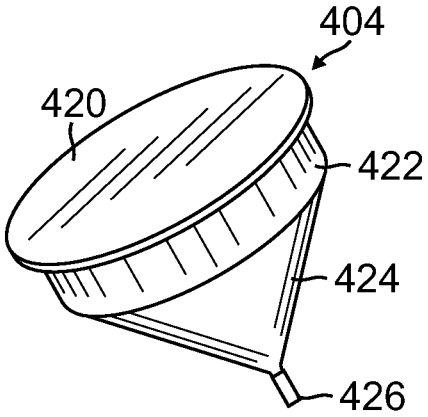

FIGS. 4B-4E illustrate the separate components that are shown assembled together as antenna 403 in FIG. 4A. For example, FIG. 4B illustrates the central conductor 404. As shown, central conductor 404 may be described as having four different sections that are fabricated as a single component, a spherical cap 420 joined to a cylindrical portion 422, a conical portion 424, and a center pin 426. In certain implementations, the different portions of the central conductor 404 are fabricated to fit with the other components of the antenna 403 such that an external surface of the spherical cap 420 conforms to the external surface of a sphere while fitting within the recessed portion 410. For example, the center pin 426 is designed to extend an electrical connection through the recessed portion 410 towards the interior of the sphere. The conical portion 424 extends the diameter of the antenna 404 within the recessed portion 410. The cylindrical portion 422 provides a surface that contacts the insulator cap 406. Further, the spherical cap 420 provides a spherical surface that conforms to the external surface of a sphere. The antenna 404 may be other shapes that differ from the shape illustrated in FIG. 4A that fit within the recessed portion 410 and conform to a sphere.

Figure 4C:
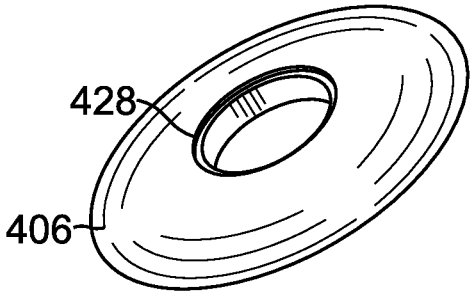
Figure 4D:
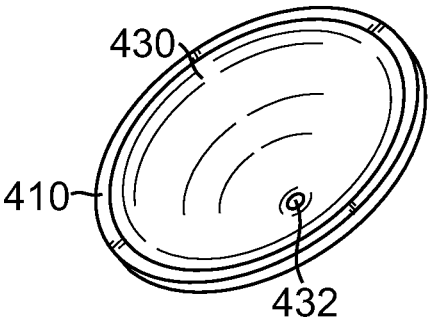

FIG. 4C illustrates a view of the insulator cap 406 according to one embodiment described herein. As shown, the spherical cap 406 is comprised of a disc having a center hole that passes through the disk. In certain implementations, a groove 428 encircles an edge of the hole. The groove 428 providing a surface for mating against the spherical cap 420 of the antenna 404. Accordingly, the groove 428 and hole, through which the antenna 404 is placed, aid in securing the antenna 404 at a desired location within the recessed portion 410 such that the surface of the spherical cap 420 of the antenna 404 conforms to the external surface of the sphere.

Figure 5A:
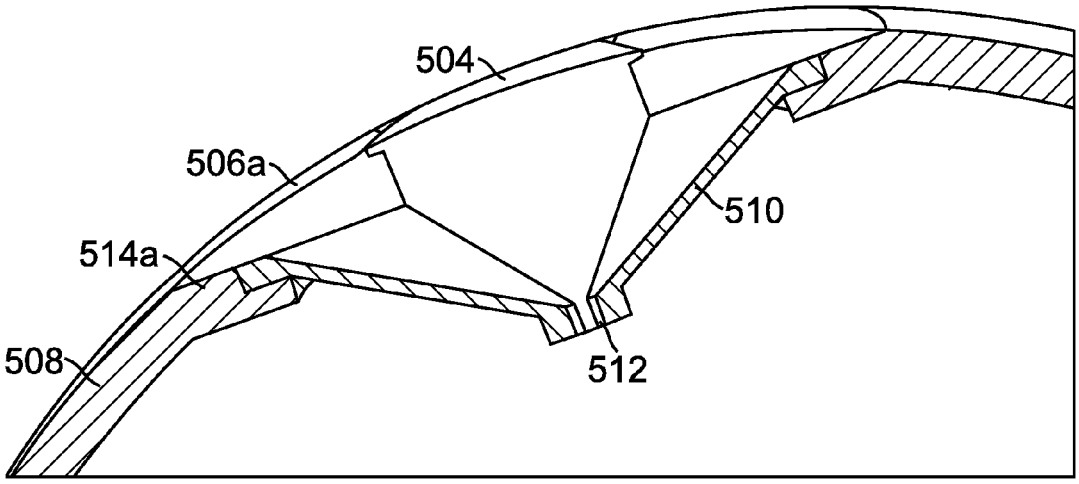
FIG. 5A-5B are cross sectional views of different embodiments for spherical caps in an antenna that is conformal to a sphere as described in the present disclosure.
Figure 5B:
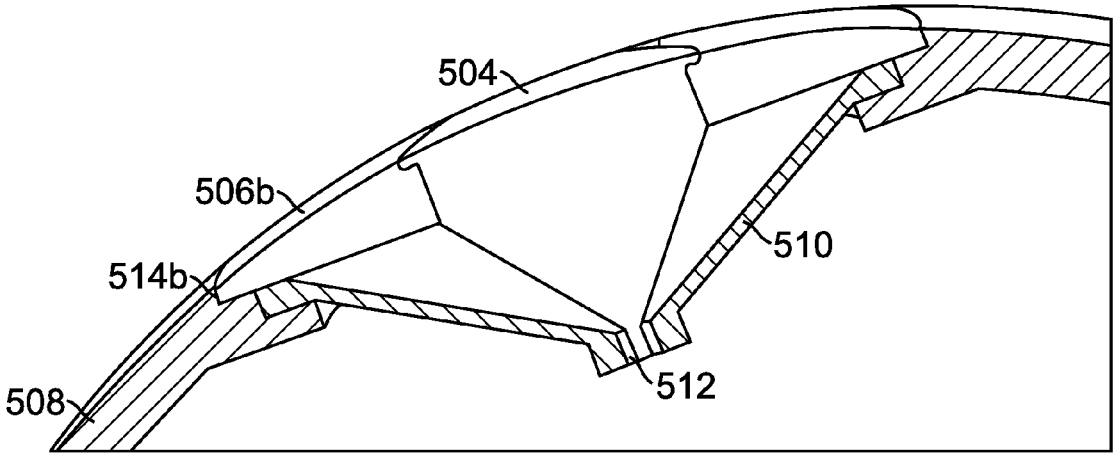

In certain embodiments, the insulator cap 406 rests against a flattened surface on the sphere. In alternative implementations, the insulator cap 406 fits into a groove formed in the sphere. FIGS. 5A and 5B illustrate different implementations for mating the insulator cap 406 against a sphere 508. FIG. 5A illustrates an insulator cap 506*a* that mates against a flattened surface 514*a* on sphere 508. To join the insulator cap 506*a* to the flattened surface 514*a*, the insulator cap 506*a* may adhere to the flattened surface 506*a* through the use of an adhesive or other bonding process.

Alternatively, the insulator cap 506*a* may be bolted to the sphere 508. FIG. 5B illustrates an alternative implementation for joining the insulator cap 506*b* to the sphere 508. As shown, sphere 508 includes a groove 514*b* into which the insulator cap 506*b* may be inserted. To preserve the spherical shape, the insulator cap 506*b* may have a flattened edge that mates against a surface of the groove 514*b*. The insulator cap 506*b* may also be adhered to the surfaces of the groove 514*b* through the use of a glue, or the groove 514*b* may comprise threads and the insulator cap 506*b* may be screwed into the groove 514*b*. Further, the insulator cap 506*b* may also be bolted to the sphere 508.

Figure 4E:
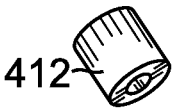

Returning to FIGS. 4A-4E, in particular FIG. 4D, a recessed portion 410 is illustrated. The recessed portion 410 comprises a conical section 430 and a neck 432. The center conductor 404 is placed within the conical section 430 and the center pin 426 extends through the neck 432 to provide an electrical connection to the interior of the sphere. In at least one implementation, the recessed portion 410 functions as an outer conductor. FIG. 4E illustrates a tubular insulator 412 that is placed within the neck 432 to electrically insulate the center pin 426 from the neck 432. In at least one implementation, the neck 432, tubular insulator 412, and center pin 426 may function as a coaxial connection as the outer surface of the neck may be threaded to connect to a coaxial cable, where the neck 432 functions as the outer conductor, the tubular insulator 412 functions as the insulation, and the center pin 426 functions as the inner conductor.

Figure 6:
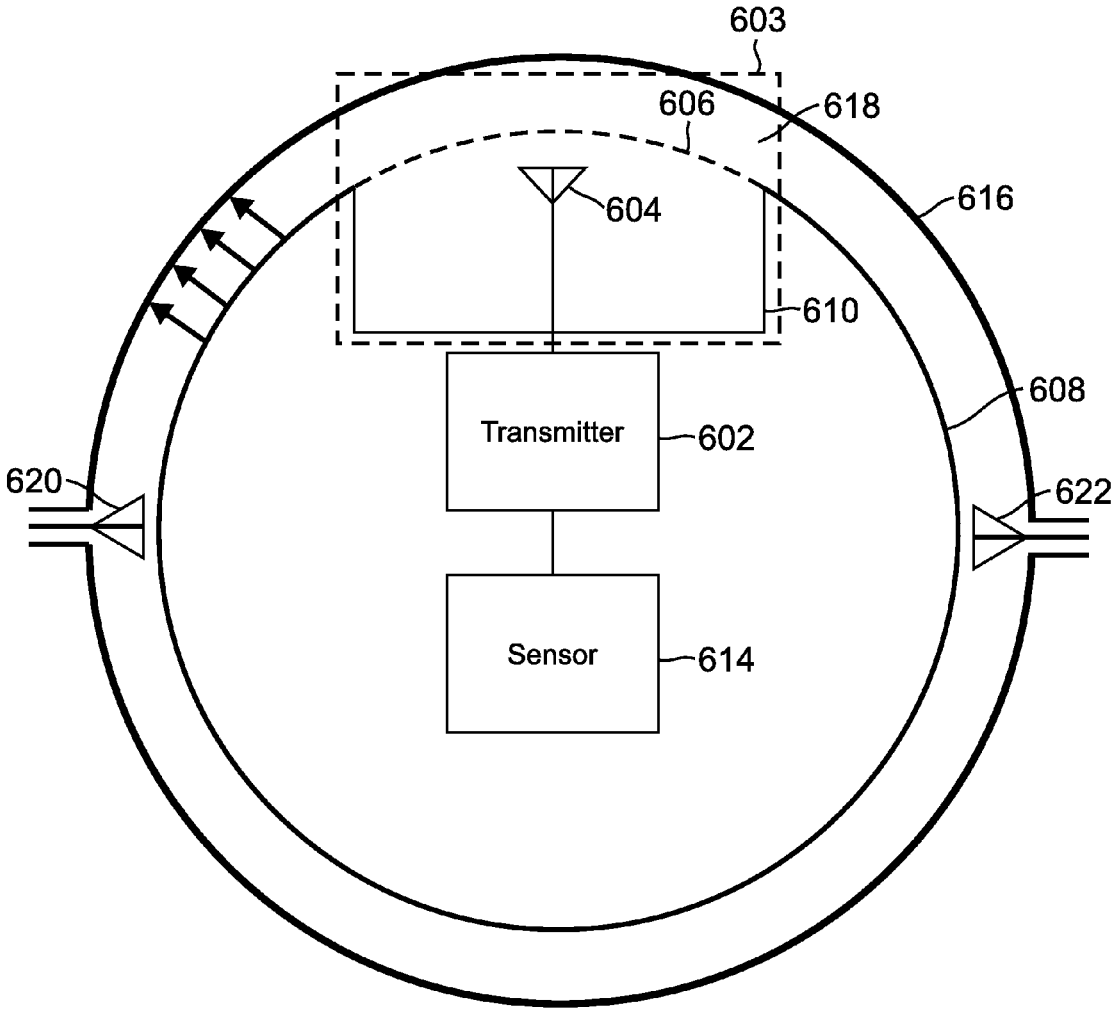
FIG. 6 is a diagram of a sensor and transmitter used with an antenna that is conformal to a sphere in one embodiment described in the present disclosure.

FIG. 6 is a diagram of one implementation for an antenna 603 conformal to a sphere. As shown, an inner sphere 608, containing the antenna 603, is placed within an outer shell 616 to form a spherical cavity 618 between the external surface of the inner sphere 608 and the inner surface of the outer shell 616. In one particular implementation of a spherical cavity 618, the spherical cavity 618 may be part of a sensor unit. The sensor unit transmits data through the spherical cavity 618. The outer shell 616, in this embodiment, is also spherical, however, it is to be understood that the outer shell 616 can also be implemented with other configurations. For example, the outer shell 616 may be implemented with a square outer surface and a spherical inner surface that forms the cavity region 618 into which the inner sphere 608 is located. The inner sphere 608 is suspended inside the outer shell 616 such that the outer surface of the inner sphere 608 does not contact the inner surface of the outer shell 616. Thus, the inner sphere 608 is capable of rotating in any direction within the outer shell 616.

In the exemplary embodiment of FIG. 6, the inner sphere 608 includes a sensor 614 and a transmitter 602. In this example, the sensor 614 may be implemented as a health monitoring sensor which monitors the status of the components located in the inner sphere 608. Sensor 614 may also be other sensor types. The sensor 614 provides data to the transmitter 602 for transmission through the spherical cavity 618. The transmitter 608 controls the modulation of a signal radiated from a transmit antenna 604.

Also located inside the spherical cavity 618 are receive antennas 620 and 622. For example, in some embodiments, the receive antenna 620 is located at an opposite side of the sphere 608 from the location of receive antenna 622. Alternatively, the receive antennas 620 and 622 may be located at any position within the outer shell 616, for example, the receive antenna 620 may be in a position that is located 90 degrees around the sphere from the position of the receive antenna 622. In at least one implementation, the receive antennas 620 and 622 may be monopole antennas that extend into the spherical cavity 618.

In certain implementations, due to the shape of the spherical cavity 618 and movement of the inner sphere 608 in the spherical cavity 618, each of receive antennas 620 and 622 may receive multiple instances of the same signal, each instance travelling a different path through the spherical cavity 618. The multi-path signals received at each antenna 620 and 622 may cause increased noise or interference in the signal received. To decrease the signal strength of the multi-path signals, an absorbing material may be applied to the interior surface of the outer shell 616. Alternatively, the absorbing material may be applied to the exterior surface of the inner sphere 608 as long as the absorbing material does not significantly interfere with the operation of the transmitting antenna 603. The absorbing material attenuates the signal such that the effects of multipath signals on the transmitted signal are negligible at the receive antennas 620 or 622. In certain implementations, as the absorbing material attenuates the signals that propagate within the spherical cavity 618, the receive antennas 620 and 622 and connected receiving electronics may be designed to receive signals at reduced reception power. Even though the primary transmitted signal is attenuated by the absorbing material, the multi-path signals are substantially more attenuated such that their effects become negligible.

In one implementation, instrumentation (such as the sensor and transmitter) are connected to the antenna 603 through a coaxial connection and then the instrumentation and antenna 603, comprising the recessed portion 610 and spherical cover 606, are placed as a single unit within the inner sphere 608. Alternatively, the instrumentation may be placed within the inner sphere 608, and then the recessed portion 610 may be placed within the inner sphere 608. In at least one implementation, the inner sphere 608 is fabricated from two hemispheres, where a portion of one or both of the hemispheres is fabricated to form the recessed portion 610. As such the instrumentation is fabricated and placed within one of the hemispheres and the two hemispheres are joined together to form the inner sphere 608. The central conductor 604 may then be joined to the insulator cap 606 and then connected to the instrumentation within the inner sphere 608.

Figure 7:
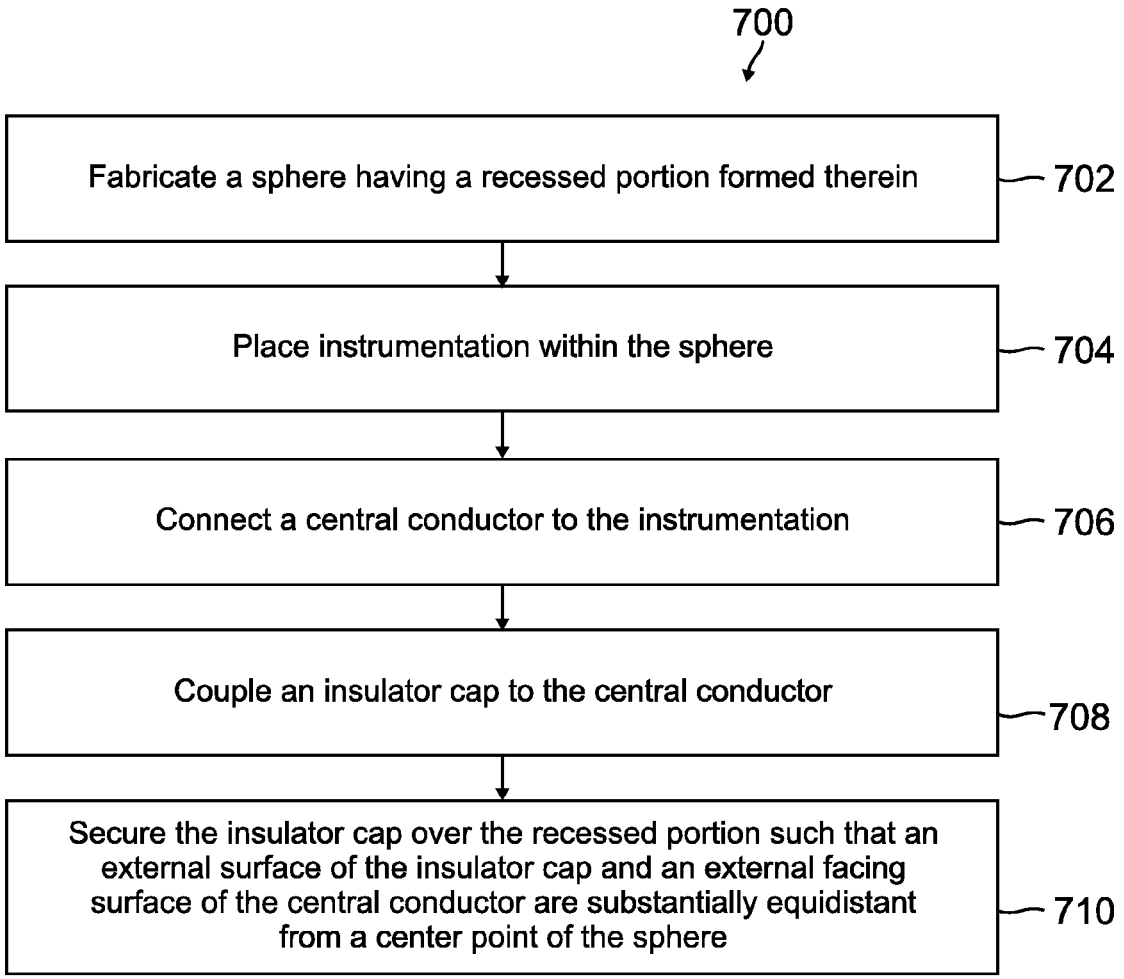
FIG. 7 is a flow diagram of a method for fabricating an antenna conformal to a sphere in one embodiment described in the present disclosure.

FIG. 7 is a flow diagram of a method 700 for fabricating an antenna conformal to a sphere. Method 700 proceeds at step 702 where a sphere is fabricated having a recessed portion formed therein. Further, method 700 proceeds at step 704 where instrumentation is placed within the sphere. For example, when a sphere is fabricated, instrumentation may be placed within the sphere through an opening in the sphere and then a conical recessed portion may be attached to the opening in the sphere. Also, method 700 proceeds at step 706 where a central conductor is connected to the instrumentation. In at least one exemplary implementation, the antenna is attached to the instrumentation via a center pin that extends through the recessed portion of the sphere.

In certain embodiments, method 700 proceeds at 708 where an insulator cap is coupled to the central conductor. In at least one example, the insulator cap is a circular radome having a center hole that is coupled to the central conductor by placing the central conductor within the hole in the insulator cap. Further, method 700 proceeds at 710 where the insulator cap is secured over the recessed portion such that an external surface of the insulator cap and an external facing surface of the central conductor are substantially equidistant from the center point of the sphere. For example, the combination of the insulator cap and the central conductor are secured to the sphere over the recessed portion such that the combination of the sphere and the external surfaces of the insulator cap and the central conductor form a complete sphere where the external surfaces are substantially equidistant from the center point of the sphere.

Example Embodiments

Example 1 includes an apparatus, the apparatus comprising: a sphere having a recessed portion formed therein, the sphere enclosing instrumentation that produces a transmittable electronic signal; a central conductor placed within the recessed portion, wherein the central conductor is coupled to the instrumentation to receive the transmittable electronic signal, wherein the transmittable electronic signal is emitted outside of the sphere; and an insulator cap located over the recessed portion, wherein locations on the external surface of the insulator cap and an external facing surface of the central conductor are substantially equidistant from a center point of the sphere.

Example 2 includes the apparatus of Example 1, wherein the spherical cap functions as a radome for electronic signals emitted from the antenna within the recessed portion.

Example 3 includes the apparatus of any of Examples 1-2, wherein the sphere is located within an outer shell, wherein a spherical cavity is formed between a surface of the sphere and an interior surface of the outer shell.

Example 4 includes the apparatus of Example 3, wherein the transmittable electronic signal is transmitted into the spherical cavity from the central conductor.

Example 5 includes the apparatus of Example 4, wherein the transmittable electronic signal is emitted as an electric field that is polarized normal to the surface of the sphere.

Example 6 includes the apparatus of any of Examples 1-5, wherein the central conductor comprises a center pin that passes through the recessed portion to couple to the instrumentations.

Example 7 includes the apparatus of Example 6, wherein a tubular insulator separates the center conductor from a neck of the recessed portion.

Example 8 includes the apparatus of Example 7, wherein the center pin, the tubular insulator, and a neck of the recessed portion form a coaxial interface for connecting to a coaxial cable that connects to the instrumentation.

Example 9 includes the apparatus of any of Examples 1-8, wherein the recessed portion and the sphere are fabricated from a metal.

Example 10 includes a method for making an antenna conformal to a sphere, the method comprising: fabricating a sphere having a recessed portion formed therein; placing instrumentation within the sphere; connecting a central conductor to the instrumentation, the central conductor having an external facing surface; coupling an insulator cap to the central conductor, the insulator cap having an external surface; and securing the insulator cap over the recessed portion such that the external surface of the insulator cap and the external facing surface of the central conductor are substantially equidistant from a center point of the sphere.

Example 11 includes the method of Example 10, wherein the insulator cap functions as a radome for electronic signals emitted from the central conductor within the recessed portion.

Example 12 includes the method of any of Examples 10-11, further comprising placing the sphere within an outer shell, wherein a spherical cavity is formed between a surface of the sphere and an interior surface of the outer shell.

Example 13 includes the method of any of Examples 10-12, wherein connecting the center conductor to the instrumentation comprises passing a center pin through the recessed portion.

Example 14 includes the method of any of Examples 10-13, wherein a tubular insulator separates the central conductor from a neck of the recessed portion.

Example 15 includes the method of Example 14, wherein the center pin, the tubular insulator, and a neck of the recessed portion form a coaxial interface for connecting to a coaxial cable that connects to the instrumentation.

Example 16 includes the method of any of Examples 10-15, wherein the recessed portion and the sphere are fabricated from a metal.

Example 17 includes the method of any of Examples 10-16, wherein fabricating the sphere comprises joining a first hemisphere to a second hemisphere.

Example 18 includes a sensor, the sensor comprising: an inner sphere having a recessed portion formed therein, the sphere enclosing instrumentation that produces a transmittable electronic signal; a central conductor placed within the recessed portion, wherein the central conductor is coupled to the instrumentation to receive the transmittable electronic signal, wherein the transmittable electronic signal is emitted outside of the sphere; an insulator cap located over the recessed portion, wherein locations on the external surface of the insulator cap and an external facing surface of the central conductor are substantially equidistant from a center point of the sphere; an outer shell enclosing the inner sphere wherein a spherical cavity is formed between a surface of the inner sphere and an interior surface of the outer shell, wherein a signal is transmitted into the spherical cavity from the central conductor; and at least one receiving antenna located within the outer shell, the at least one receiving antenna configured to receive the signal transmitted from the central conductor.

Example 19 includes the sensor of Example 18, wherein the insulator cap functions as a radome for electronic signals emitted from the antenna within the recessed portion.

Example 20 includes the apparatus of any of Examples 18-19, wherein a center pin of the central conductor, a tubular insulator, and a neck of the recessed portion form a coaxial interface for connecting to a coaxial cable that connects to the instrumentation.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. An apparatus, the apparatus comprising:

a sphere having a recessed portion formed therein, the sphere enclosing instrumentation that produces a transmittable electronic signal;

a central conductor placed within the recessed portion, wherein the central conductor is coupled to the instrumentation to receive the transmittable electronic signal, wherein the transmittable electronic signal is emitted outside of the sphere; and an insulator cap located over the recessed portion, wherein locations on the external surface of the insulator cap and an external facing surface of the central conductor are substantially equidistant from a center point of the sphere.

2. The apparatus of claim 1, wherein the insulator cap functions as a radome for electronic signals emitted from the antenna within the recessed portion.

3. The apparatus of claim 1, wherein the sphere is located within an outer shell, wherein a spherical cavity is formed between a surface of the sphere and an interior surface of the outer shell.

4. The apparatus of claim 3, wherein the transmittable electronic signal is transmitted into the spherical cavity from the central conductor.

5. The apparatus of claim 4, wherein the transmittable electronic signal is emitted as an electric field that is polarized normal to the surface of the sphere.

6. The apparatus of claim 1, wherein the central conductor comprises a center pin that passes through the recessed portion to couple to the instrumentations.

7. The apparatus of claim 6, wherein a tubular insulator separates the center conductor from a neck of the recessed portion.

8. The apparatus of claim 7, wherein the center pin, the tubular insulator, and a neck of the recessed portion form a coaxial interface for connecting to a coaxial cable that connects to the instrumentation.

9. The apparatus of claim 1, wherein the recessed portion and the sphere are fabricated from a metal.

10. A method for making an antenna conformal to a sphere, the method comprising:

fabricating a sphere having a recessed portion formed therein;

placing instrumentation within the sphere;

connecting a central conductor to the instrumentation, the central conductor having an external facing surface;

coupling an insulator cap to the central conductor, the insulator cap having an external surface; and securing the insulator cap over the recessed portion such that the external surface of the insulator cap and the external facing surface of the central conductor are substantially equidistant from a center point of the sphere.

11. The method of claim 10, wherein the insulator cap functions as a radome for electronic signals emitted from the central conductor within the recessed portion.

12. The method of claim 10, further comprising placing the sphere within an outer shell, wherein a spherical cavity is formed between a surface of the sphere and an interior surface of the outer shell.

13. The method of claim 10, wherein connecting the center conductor to the instrumentation comprises passing a center pin through the recessed portion.

14. The method of claim 10, wherein a tubular insulator separates the central conductor from a neck of the recessed portion.

15. The method of claim 14, wherein the center pin, the tubular insulator, and a neck of the recessed portion form a coaxial interface for connecting to a coaxial cable that connects to the instrumentation.

16. The method of claim 10, wherein the recessed portion and the sphere are fabricated from a metal.

17. The method of claim 10, wherein fabricating the sphere comprises joining a first hemisphere to a second hemisphere.

18. A sensor, the sensor comprising:

an inner sphere having a recessed portion formed therein, the sphere enclosing instrumentation that produces a transmittable electronic signal;

a central conductor placed within the recessed portion, wherein the central conductor is coupled to the instrumentation to receive the transmittable electronic signal, wherein the transmittable electronic signal is emitted outside of the sphere;

an insulator cap located over the recessed portion, wherein locations on the external surface of the insulator cap and an external facing surface of the central conductor are substantially equidistant from a center point of the sphere;

an outer shell enclosing the inner sphere wherein a spherical cavity is formed between a surface of the inner sphere and an interior surface of the outer shell, wherein a signal is transmitted into the spherical cavity from the central conductor; and at least one receiving antenna located within the outer shell, the at least one receiving antenna configured to receive the signal transmitted from the central conductor.

19. The sensor of claim 18, wherein the insulator cap functions as a radome for electronic signals emitted from the antenna within the recessed portion.

20. The apparatus of claim 18, wherein a center pin of the central conductor, a tubular insulator, and a neck of the recessed portion form a coaxial interface for connecting to a coaxial cable that connects to the instrumentation.

* * * * *